United States Patent [19]

Czeczerski

[11] 4,090,421

[45] May 23, 1978

[54] SPARK PLUG TIGHTENER

[76] Inventor: Nordfried Czeczerski, Freinsheimer Strasse 88, 6711 Frankenthal-Flomersheim, Germany

[21] Appl. No.: 750,820

[22] Filed: Dec. 15, 1976

[30] Foreign Application Priority Data

Jun. 24, 1976 Germany ..... 7620041

[51] Int. Cl.[2] ..... B25B 23/14

[52] U.S. Cl. ..... 81/52.4 R

[58] Field of Search ..... 81/52.4 R, 52.4 A

[56] References Cited

U.S. PATENT DOCUMENTS

| | | | |
|---|---|---|---|
| 3,012,456 | 12/1961 | Dracka | 81/52.4 R |
| 3,876,369 | 4/1975 | Behrens | 81/52.4 R |
| 3,889,490 | 6/1975 | Nadolny | 81/52.4 R |
| 3,906,819 | 9/1975 | Curtis | 81/52.4 R |

*Primary Examiner*—James L. Jones, Jr.
*Attorney, Agent, or Firm*—Staas & Halsey

[57] ABSTRACT

The invention relates to a spark plug tightener with a cylindrical housing having on one end a multi-faceted opening for engaging the spark plug and on the other end an annular shaped profile in front view through which passes a turning shaft with a corresponding profile in front view whereby the turning shaft is held under the tension of cup springs by means of a cover cap screwed over the housing.

2 Claims, 10 Drawing Figures

SPARK PLUG TIGHTENER

BACKGROUND AND SUMMARY OF INVENTION

Although simple plug tighteners are known which transmit limited torque in one direction, with such constructions the torque does not occur directly in the vicinity of the spark plug but rather is transmitted by a shaft or a permanently connected tightener. Because of the construction of many motors large spark plug tighteners with torque-limiting characteristics cannot be used, and thus the degree of tightening of the spark plugs in such motors is left for the most part to the judgment of the mechanic. Spark plugs, however, should be tightened with a definite torque, because only in this way can protection of the light metal housing of the motor block be guaranteed and the necessary electron gap of the spark plugs retained. Regardless of how much care may be given to the setting of the gap in the spark plugs, with the uncontrolled turning of the plugs during installation, the best preparations can be destroyed, because the separation between the electrodes can change with the applied force. It is also apparent that damage to the threads may occur, which could result in frequently having to replace the thread windings. The spark plug tightener of the present invention is designed to permit the spark plug to be secured with a determinable torque, and upon exceeding the set torque to release the plug, while permitting a higher torque to be applied to the plug in the reverse direction when it is desired to remove the plug.

The foregoing objectives are accomplished by the present invention by the housing and the turning shaft being provided with radially extending trapezoidally-formed depressions and elevations with steeply sloping sides, and with the housing having an inner set of teeth in which a ratchet engages for increasing the torque in the reverse direction, which ratchet is situated in the shaft extending through the housing.

In one embodiment of the present invention the inner teeth of the housing are tangentially oriented, and the ratchet is a key wich engages the inner teeth by means of a spring motion out of a cavity in the shaft.

In the spark plug tightener of the present invention, over-tightening cannot occur, with resulting damage to the threads, and the spark plug can be secured with the desired adjustable torque. As soon as the desired torque is attained, the noise of the depressions and elevations sliding over each other indicates to the mechanic that the installation of the spark plug is complete.

Another advantage of the present invention is that the construction of the tightener is very simple, and does not exceed the dimesnions of conventional spark plug tighteners. Thus, the tightener may be used in different arrangements with differently constructed types of spark plugs in different motors with the use of extensions. Because the torque is determinable, the threads are protected with the optimum compression.

Still further, the inner teeth acting together with the ratchet allows a such higher torque to be applied for unscrewing, which is often necessary for removing plugs. Tighteners with reverse ratchets are known; however, with such tighteners the reverse motion occurs without transmitting any torque.

Still further, the housing and the cover of the invention have a scale with which the torque of the spark plug tightener can be set.

DESCRIPTION OF THE PREFERRED EMBODIMENT

Figure 1:
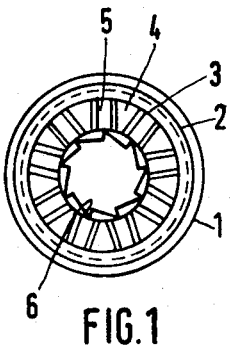
FIG. 1 is a plan view of the cylindrical housing of the spark plug tightener of the present invention.
Figure 2:
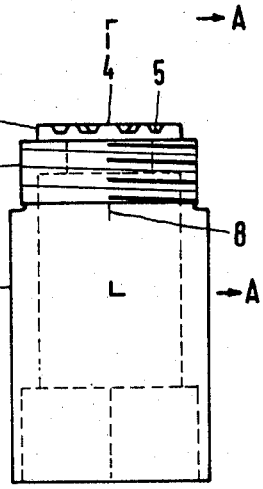
FIG. 2 is an elevation view of the housing shown in FIG. 1.
Figure 3:
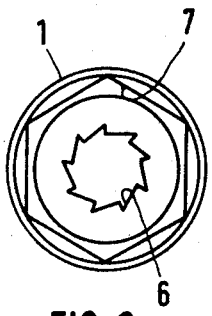
FIG. 3 is a bottom plan view of the housing, as shown in FIGS. 1 and 2.

As shown in FIGS. 1, 2, and 3 the spark plug tightener of the present invention consists of a cylindrical housing 1, which at the upper end thereof is provided with threads at the indicated recess 2. Above the recess 2 is a smaller recess 3, which in front view has an annular or torus profile. The top face consists of radially order trapezoidal elevations 4 and depressions 5, and the elevations 4 are wedge shaped towards the axis. The elevations 4 have sides which slope downwardly into the depressions 5, and the plans of these sloping sides have parallel edges. These sides rise at an agle of between 30° and 60°, and are preferentially at 30°. Inside the portion 2 of the housing 1 are located inner teeth 6 having tangentially disposed teeth. The other faces of the teeth 6 are positioned approximately radially, that is, perpendicular to the other faces. The housing 1 has at the other end thereof an opening 7, permitting the insulator of the spark plug to be inserted therethrough.

Figure 4A:
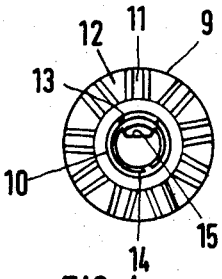
FIG. 4*a* is a bottom plan view of the turning shaft.
Figure 4B:
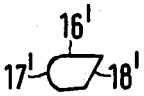
FIG. 4*b* is a plan view of the reverse turn ratchet which is in the form of a key.
Figure 5:
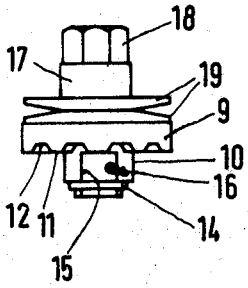
FIG. 5 is an elevation view of the turning shaft.
Figure 6:
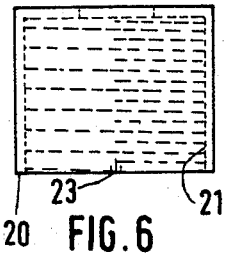
FIG. 6 is an elevation view of the cover.
Figure 7:
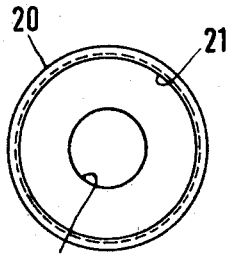
FIG. 7 is a bottom plan view of the cover of FIG. 6.
Figure 8:
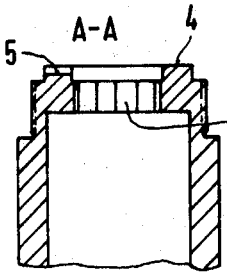
FIG. 8 is a cross-sectional view taken along line A—A of FIG. 2.

FIGS. 4 and 5 illustrate the turning shaft provided with a flange 9 with a shaft 10 positioned downwardly and a shaft 17 with an engaging configuration 18 for connecting to another tool for tightening purposes. The annular surface of the flange 9 of the turning shaft opposing the front end of the housing 1 has a front profile corresponding to that of the housing 1, and a corresponding bottom face configuration consisting of elevations 11 and depressions 12 for torque transmission in the forward direction up to the set limit. This engaging configuration corresponds to that of the housing in in that the elevations 11 are oriented radially with parallel edges while the depressions are radially ordered and wedge shaped towards the axis. This configuration is therefore the opposite of that of the housing 1 while the steepness of the sides is the same. The shaft 10 has a recess 15 in which a small key 16' is arranged. The dimension 13 of the recess 15 corresponds to the dimension 17' of the key 16'. There is also arranged in the recess 15 a small spring 16, which rests on the sloping flange 18' of the key 16' and pushes the key 16' into the inner teeth 6 of the cavity 2 of the housing 1.

The turning shaft 9 is held by the cover 20 with the cup springs 19 on the shaft 17. The cover 20 has inner threads 21 which are screwed over the threads of section 2 of the housing 1. Marks 8 on the housing 1 and marks 23 on the cover 20 show the exact setting of the torque. For setting the desired torque, the cover 20 can be correspondingly screwed, compressing the cup springs 19 to cause a change in force between the matching engaging configurations on the housing 1 and the flange 9, such that the corresponding torque is produced. In forward turning, the key 16' glides over the long side of the tooth, and in reverse turning the key 16' positions itself in the inner tooth 6 and a much higher moment can be produced. The top end of the turning shaft 9 has a configuration 18 for engaging extensions for securing the spark plugs.

In the assembly of the spark plug tighteners and after setting any desired torque with the shaft 17 extending through the opening 22 of the cover 20, the shaft 17 can be conveniently bonded to the housing 1, for example, with casting resin introduced into the treads.

A retaining ring 14 is inserted in the groove in the shaft 10 to prevent the key 16' from falling out. As a variation of the embodiment of the engaging profile, as of the elvations and depressions designed to slide over each other with torque exceeding the set value, the sides of the elevations can be rounded off at the point of joining the flat elevated and depressed trapezoidal.

Figure 9:
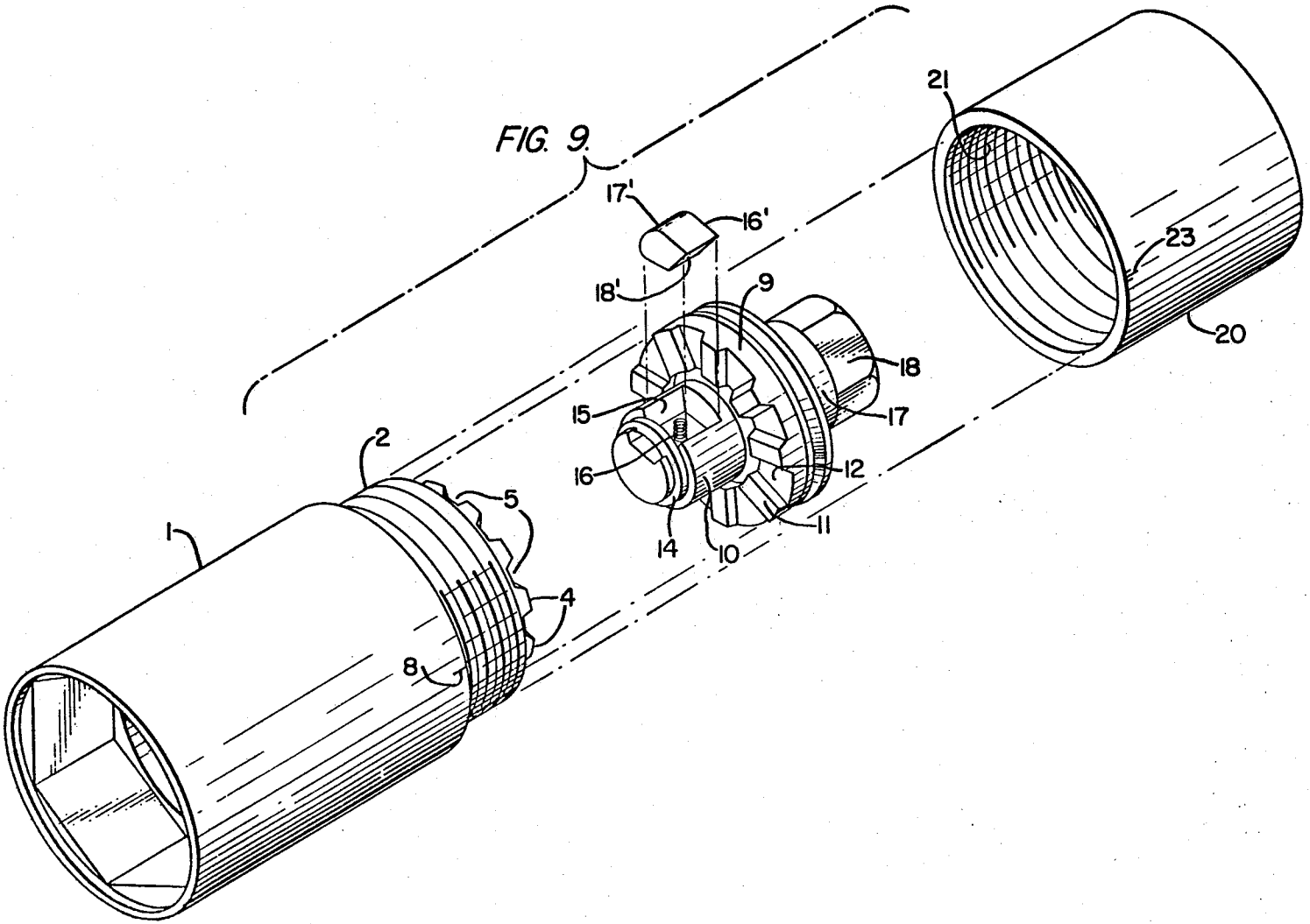
FIG. 9 is a perspective view of the component parts prior to assembly thereof.

FIG. 9 is a perspective view showing the component parts in exploded form prior to the screwing on and adjusting of the cover 20 by means of the internal screw threads 21 upon the external threads 2 of the cylindrical housing 1.

I claim:

1. In a spark plug tightener having a cylindrical housing having at one end thereof a multi-faceted opening and at the other end thereof an annularly formed shape in front view profile with an engaging configuration on the top, a turning shaft with corresponding front views and configuration on the bottom for engaging said configuration on top of said housing and held under pressure from cup springs by a cover screwed over the housing, the improvement, wherein said engaging configuration on the top of said housing and bottom of said shaft comprises radially oriented trapezoidal elevations and depressions with steeply sloping sides provided on said housing and shaft, cup springs carried on said shaft adjacent the cover providing pressure between the engaging configurations on the housing and shaft, inner teeth provided on said housing, and a ratchet arranged in said shaft and extending through said housing and engaging said teeth for raising the reverse torque.

2. A spark plug tightener as in claim 1, wherein one of the faces of said inner teeth of said housing is arranged approximately tangentially and the said ratchet comprises a key provided with a spring motion in a recess provided inside said shaft at the height of said inner teeth.

* * * * *

UNITED STATES PATENT AND TRADEMARK OFFICE

CERTIFICATE OF CORRECTION

PATENT NO. : 4,090,421

DATED : May 23, 1978

INVENTOR(S) : Nordfried Czeczerski

It is certified that error appears in the above-identified patent and that said Letters Patent are hereby corrected as shown below:

Column 1, line 42, "wich" should be -- which --;

Column 1, line 54, "dimesnions" should be -- dimensions --;

Column 2, line 33, "agle" should be -- angle --;

Column 3, line 17, "treads" should be -- threads --;

Column 3, line 21, "elvations" should be -- elevations --.

Signed and Sealed this

*Thirty-first* Day of *October 1978*

[SEAL]

*Attest:*

RUTH C. MASON
*Attesting Officer*

DONALD W. BANNER
*Commissioner of Patents and Trademarks*